United States Patent [19]

Bergamo et al.

[11] Patent Number: 4,505,999

[45] Date of Patent: Mar. 19, 1985

[54] PHOTOGRAPHIC PROCESS FOR APPLYING PHOSPHOR PATTERN TO COLOR CRT SHADOW MASK

[75] Inventors: Robert L. Bergamo; Gordon T. Foreman, both of Seneca Falls; Anthony V. Gallaro, Auburn; Judy A. Nagel, Romulus, all of N.Y.

[73] Assignee: North American Philips Consumer Electronics Corp., New York, N.Y.

[21] Appl. No.: 531,140

[22] Filed: Sep. 12, 1983

[51] Int. Cl.[3] ..... G03C 5/00

[52] U.S. Cl. ..... 430/24; 430/23; 430/28; 430/326; 430/328; 430/330; 430/540

[58] Field of Search ..... 430/24, 28, 165, 166, 430/326, 328, 330, 23

[56] References Cited

U.S. PATENT DOCUMENTS

| | | | |
|---|---|---|---|
| 3,224,895 | 12/1965 | Rebel | 430/24 |
| 3,226,246 | 12/1965 | Vermeulen et al. | 430/24 |
| 3,620,735 | 11/1971 | Ulano | 430/270 |
| 3,804,621 | 4/1974 | McIntosh | 430/325 |
| 4,049,452 | 9/1977 | Nekut | 430/28 |
| 4,154,613 | 5/1979 | Doering | 430/24 |
| 4,248,947 | 2/1981 | Oikawa | 430/24 |
| 4,339,528 | 7/1982 | Goldman | 430/323 |

*Primary Examiner*—Charles L. Bowers, Jr.
*Attorney, Agent, or Firm*—Thomas A. Briody; Jack Oisher; John C. Fox

[57] ABSTRACT

Phosphor characters to supply feedback information for an automatic convergence system are applied to the gun side of the shadow mask of a color cathode ray tube by a method of applying layers of a positive-working photoresist and phosphor, exposing the layers through a positive photomask, back exposing to clear the shadow mask apertures, developing to remove the exposed areas, and baking to remove the photoresist.

8 Claims, 6 Drawing Figures

PHOTOGRAPHIC PROCESS FOR APPLYING PHOSPHOR PATTERN TO COLOR CRT SHADOW MASK

CROSS-REFERENCE TO RELATED APPLICATIONS

Co-pending U.S. patent applications assigned to the present assignee and directed to various features of the feedback color cathode ray tube described herein are as follows: Ser. No. 448,468, filed Dec. 10, 1982 (transparent conductive window); Ser. No. 449,897, filed Dec. 15, 1982 (getter structure); Ser. No. 496,358, filed May 20, 1983 (applying phosphor to the shadow mask); and Ser. No. 525,758, filed Aug. 23, 1983 (arc suppression structure).

BACKGROUND OF THE INVENTION

This invention relates to a color cathode ray tube (CCRT) having feedback features for an automatic convergence system, and more particularly relates to a photographic process for applying a phosphor pattern to the shadow mask of such a CCRT.

An automatic convergence system has recently been developed for high resolution CCRT displays expected to have application in such demanding fields as computer aided design (CAD) and cartography. See ELECTRONIC PRODUCTS, May 12, 1983, p. 17. Essential to such an auto-convergence system are certain feedback features in the CCRT, which provide information on the location of the scanning electron beams to a computer, which then corrects any misconvergence of the beams. Such feedback features include a phosphor pattern on the back or gun side of the tube's shadow mask, and a window in the side of the tube. When struck by the scanning electron beams, the phosphor pattern emits radiation, some of which is transmitted through the window and detected by an externally placed photomultiplier tube.

The technology for applying the red, green and blue-emitting phosphors to the inside surface of the glass viewing panel of CCRTs is well developed. It is based upon a photolithographic technique in which each of the three phosphor patterns is formed by light exposure of a phosphor-photoresist layer through the shadow mask. Subsequent development and baking of the exposed layer leaves an adherent pattern of phosphor particles on the glass panel.

In contrast, there is no generally accepted technique for applying a phosphor pattern to the mask. Various considerations arise, due to the unique nature of the application. The mask is metallic, bears a protective oxide coating, is relatively fragile and expensive to fabricate. Also, since it is used as the photolighographic "negative" during formation of the phosphor screen on the viewing panel, it becomes "married" to that screened panel. Thus, any subsequent damage to the mask results in rejection not only of the mask but also of the panel. Finally, the mask apertures must be relatively small in size and large in number to produce the desired resolution for high quality display images on the viewing screen. Even partial blocking of the apertures could result in decreased brightness of the image. Any phosphor pattern on the mask which bridges individual apertures, as does the desired phosphor feedback pattern, risks the possibility of blocking of these apertures during pattern application.

In one proposed process, (Ser. No. 496,358, referred to above), the mask is sprayed through a pattern stencil in contact with the mask with a dispersion of fine particle size phosphors in a coating vehicle containing a dispersant and a temporary binder. The sprayed coating is subsequently baked to remove the vehicle and leave an adherent layer of phosphor particles on the mask.

While this process has been used successfully in the manufacture of small numbers of tubes, it has been found difficult to accurately locate and maintain intimate contact between the stencil and the curved surface of the mask. Thus, mislocated and poorly defined phosphor patterns sometimes result. In addition, the need for sufficient phosphor to achieve adequate emission levels for later detection dictates that a relatively thick spray coating be applied. However, as coating thickness increases, phosphor particles accummulate in the area of the mask apertures, decreasing the size, or even blocking such apertures. The phosphor pattern then becomes obvious and distracting to the viewer of the display screen image.

OBJECTS AND SUMMARY OF THE INVENTION

Accordingly, it is an object of the invention to provide a process for applying a phosphor pattern to the shadow mask of a CCRT. It is also an object of the invention to provide such a process which does not rely upon the use of a pattern stencil to define the phosphor pattern, and which enables the application of a phosphor pattern without reducing the size of, or blocking the mask apertures.

In accordance with the invention, a photographic process for providing a phosphor pattern on a CCRT shadow mask comprises the steps of:

(a) applying a uniform layer of a positive-working photoresist composition to the shadow mask surface, at least in the areas where phosphor is desired;

(b) applying a uniform layer of phosphor particles in contact with the photoresist layer;

(c) exposing the photoresist layer to actinic radiation through a positive photomask to solubilize the exposed portions of the photoresist layer;

(d) exposing the reverse side of the shadow mask to actinic radiation to solubilize portions of the photoresist layer in the aperture areas of the shadow mask;

(e) contacting the photoresist layer with a solvent to remove the solubilized portions of the layer; and (f) baking the shadow mask to remove the remaining photoresist, to leave a uniform, adherent phosphor pattern layer on the mask.

In the presently preferred embodiment of the invention, a suspension of fine particle size phosphor is dispersed in a positive working photoresist composition, and the resultant slurry is sprayed onto the shadow mask. Thus, the uniform layers of the photoresist composition and phosphor particles are formed simultaneously. The sprayed layer is then exposed, developed and baked, as described above.

In another preferred embodiment, the positive-working photoresist composition is a mixture in water of a simple ferric salt, a stable ferric acid salt, polyvinyl alcohol and a diol. Such a composition is completely developable in water, a cheap, nontoxic, and non-corrosive solvent, which will not attack the surface oxide layer of the shadow mask. Use of such a composition requires removal of sufficient water following exposure to render the unexposed portions completely insoluble, as will be described more fully herein. This composition and its use as a positiveworking photoresist are described and claimed in co-pending U.S. patent application Ser. No. 364,949, filed April 2, 1982, and assigned to the present assignee.

BRIEF DESCRIPTION OF THE DRAWINGS

FIG. 4(*b*) is a section view of the mask portion of FIG. 4(*a*) after exposure and development.

DESCRIPTION OF THE PREFERRED EMBODIMENT

For a fuller understanding of the present invention, together with other and further objects, advantages and capabilities thereof, reference is made to the following disclosure and appended claims.

Figure 1:
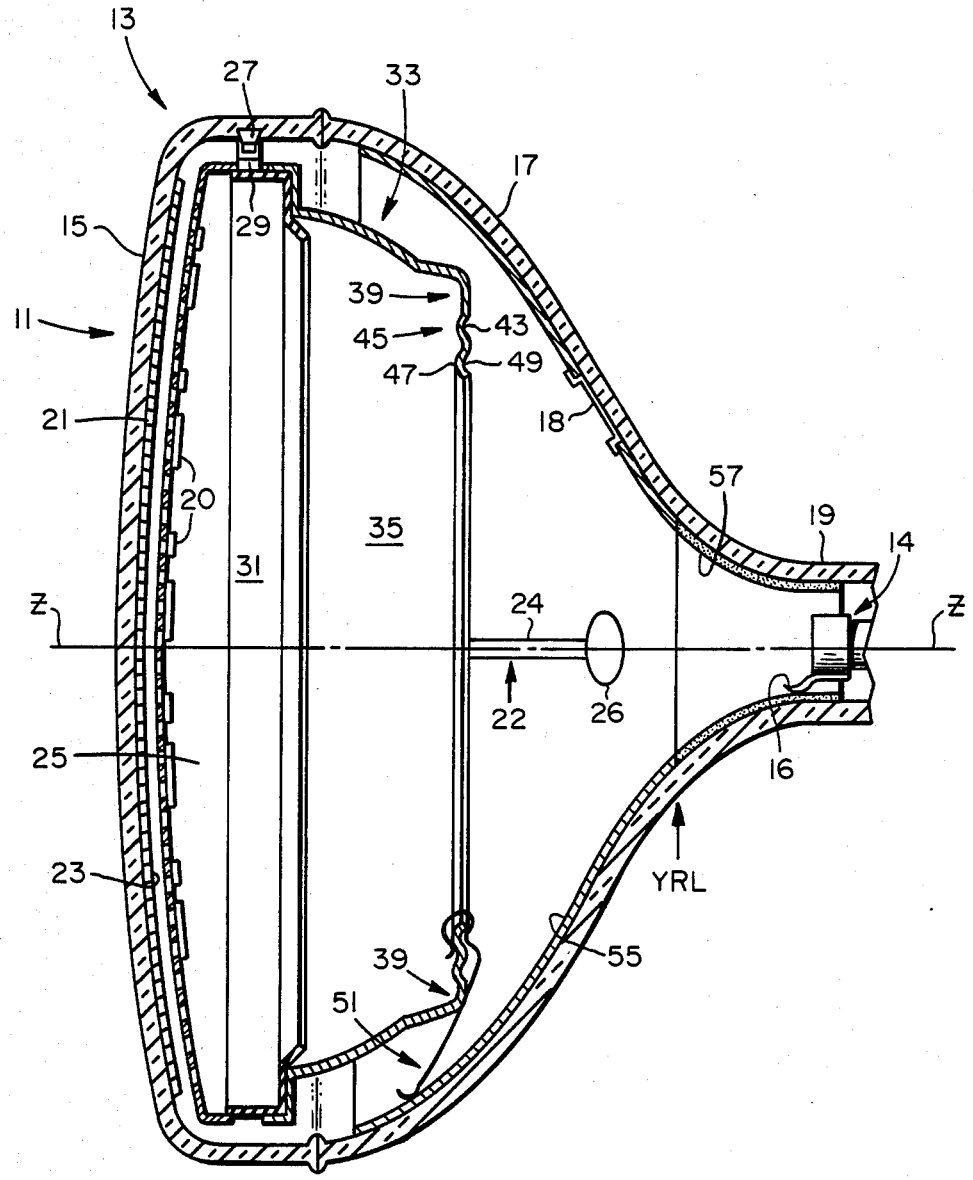
FIG. 1 is a cross-section of one embodiment of a color cathode ray tube of the invention.
Figure 2:
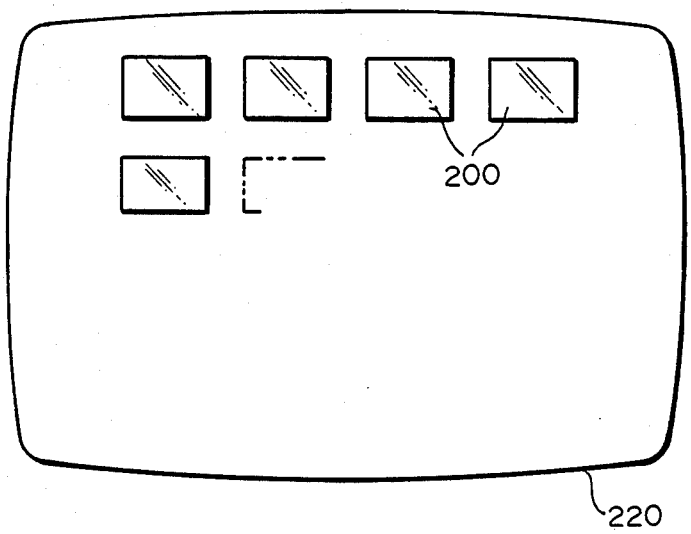
FIG. 2 is a plan view of a spray stencil used in one embodiment of the invention.

The cathode ray tube 11, shown in FIG. 1, is an exemplary color tube having a longitudinal Z axis and embodying an envelope 13 comprised of an integration of viewing panel 15, funnel 17 and neck 19 portions. Adhered to the inner surface of the viewing panel 15 is a patterned cathodoluminescent screen 21 formed of a multitude of discrete areas of color-emitting phosphor materials. A thin metallized film 23, such as aluminum, is usually applied over the interior surface of the screen and a portion of the sidewall area of the panel. A multiapertured structure or shadow mask member 25 is spatially related to the patterned screen 21 being positioned within the viewing panel 15 by a plurality of stud-like mask supporting members 27 partially embedded in the panel sidewall in spaced-apart orientation. Mating with these supporting studs are a like number of mask locator means 29 which are suitably affixed to the frame portion 31 of the mask member 25. Mask member 25 directs the electron beams from plural beam electron gun 14 to the desired phosphor elements on screen 21.

Attached to the rear portion of the mask frame is an internal magnetic shielding member (IMS) 33 for shielding the beams from external stray magnetic fields. This structure has a bowl-like sidewall enclosure 35 with front and rear openings, the rear opening defined by ledge 39. Contactor 51 effects electrical contact with the internal conductive coating 55 disposed on the interior surface of the funnel 17. Coating 55 extends from the forward portion of funnel 17 to the yoke reference line (YRL), while contiguous internal arc suppression coating 57 extends from the YRL into the neck 19 where it makes electrical contact with gun 14 by way of snubber 16. Getter assembly 22 attached to IMS 33 contains a getter material to be flashed during tube manufacture.

A phosphor pattern on the back of mask 25, denoted by character 20, emits radiation toward the rear of the tube upon being struck by electron beams from gun 14. Window 18 in coating 55 passes some portion of this radiation to an externally placed detector such as a photomultiplier tube, not shown.

The phosphor used for character elements 20 is preferably fine particle size, in order to avoid a coarse texture which could result in either partially or totally blocked mask apertures, or poor adherence, or both. In addition, the phosphor particles should be uniformly distributed to insure uniformity of application and of emission upon later excitation by the scanning electron beams.

The particular phosphor chosen will, of course, depend on the application and especially upon the type and sensitivity of the emission detector chosen. A cerium-activated yttrium silicate ($Y_2Si_2O_5$:Ce) has been found to be particularly suitable for use with UV emission detectors, such as photomultiplier tubes. It may also be advantageous for process control to include a small amount of a "tracer" phosphor, which is easily excited and detected during manufacture, such as by hand-held UV units. Such a tracer phospnor is particularly useful for detecting non-uniform coatings. An exemplary tracer phosphor is the red-emitting europium-activated yttrium vanadate ($YVO_4$:Eu), which may be present in an amount ranging from about ½ to 10 weight percent of the phosphor composition.

In accordance with the invention, the phosphor pattern is produced by a photographic process which facilitates deposition of sufficient phosphor for an adequate signal without reduced or blocked apertures by providing for clearing of the mask apertures by back exposure through the shadow mask to solubilize exposed portions of the photoresist layer.

The preferred photoresist composition comprises a mixture in water of a ferric salt, such as ferric nitrate or sulfate, a ferric acid salt, such as ferric ammonium citrate or oxalate, polyvinyl alcohol, and a diol, such as butane or pentane diol. Such a composition and its use are described and claimed in copending U.S. patent application Ser. No. 364,949, filed Apr. 2, 1982. In use, a thin layer of the mixture is provided on a substrate, the layer is dried sufficiently to become immobile, exposed to actinic (ultra violet) radiation to cause the exposed areas to become water soluble, dried to remove remaining water and thereby render water insoluble the unexposed areas, (e.g., by moderate heating at 1O° to 50° above ambient), and developed in water to remove the unexposed portions.

Use of such a positive-working photoresist in which exposed portions are solubilized (as opposed to a negative-working photoresist, in which exposed portions are insolubilized), has the advantage of enabling back exposure to clear the shadow mask apertures.

The resulting coating may be painted, sprayed or otherwise applied to the mask, preferably through a stencil to achieve a desired pattern.

If a defect occurs in either coating operation prior to baking, either the photoresist layer or the phosphor layer may be completely removed by an aqueous wash.

The photoresist and phosphor layers are preferably produced simultaneously by spraying a slurry of fine particle size phosphor dispersed in a positive-working photoresist composition.

The photoresist composition for use in making the slurry composition for application to the aperture mask should contain in weight percent about 0.80 to 3.5 percent ferric salt, about 1 to 5 percent ferric ammonium salt, about 2 to 8 percent PVA, about 1.5 to 6 percent diol, remainder water.

The preferred method of forming the slurry is to first prepare a fine particle size dispersion of the phosphor particles suspended in their own liquid vehicle, such as by milling large particle size phosphor of the desired composition with a liquid vehicle for a time sufficient to achieve significant reduction of phosphor particle size. For example, a beginning average particle size of about 7 to 9 microns may be reduced to about 0.5 to 2.5 microns after milling for about 15 to 25 hours. Alternatively, fine particle size phosphor may be milled for a sufficient time to achieve adequate dispersion in the vehicle, e.g., 2 to 4 hours.

Water is particularly suitable as a base for the vehicle, which may additionally contain ethyl alcohol, which tends to prevent foaming and running of the coating during and after spraying.

The coating vehicle also may contain a dispersant, to keep the phosphor particles separated and suspended in the vehicle. Some suitable dispersants are Marasperse N-22 and CB (lignosulfatebased dispersants marketed by American Can Company), DAXAD (sulfonic acid-based dispersants) marketed by W. R. Grace & Company, and Triton X-100 (marketed by Rohm & Haas Co.). Marasperse N-22 is preferred. The amount of dispersant in the coating composition may range from about 0.05 to 1 or more weight percent, the particular amount required increasing with the amount of solids (phosphor particles) present in the coating vehicle.

The phosphor suspension for use in making the slurry would typically contain in weight percent about 20 to 60 percent phosphor, about 0.4 to 2.0 percent dispersant, remainder water, with up to 50 percent of the water replaced by ethyl alcohol.

The phosphor suspension is then added to the photoresist composition and thoroughly mixed, such as by mechanical agitation. Milling of the photoresist should in general be avoided due to the tendency of the polyvinyl alcohol to cause foaming of the slurry.

A suitable slurry for spraying results from mixing photoresist and phosphor suspension in the weight ratio of about 1.5 to 2.5 parts photoresist to 1 part of phosphor suspension. Also, from ½ to 1½ parts of ethyl alcohol may be added for additional control of foaming during spraying and drying of the sprayed coating.

Such a slurry would typically contain in weight percent about 0.5 to 2 percent ferric ammonium salt, about 0.4 to 2 percent ferric salt, about 0.9 to 4 percent polyvinyl alcohol, about 0.6 to 2.6 percent diol, about 5 to 20 percent phosphor, about 15 to 45 percent ethyl alcohol, remainder water.

Figure 3:
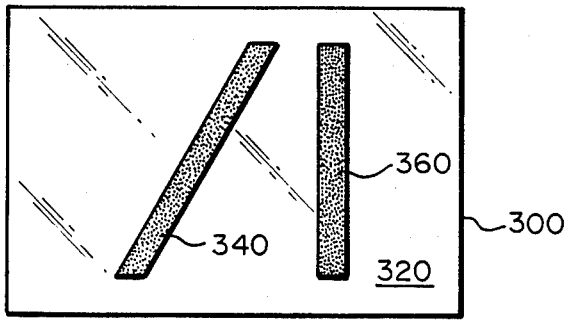
FIG. 3 is a plan view of a portion of a positive photomask used in conjunction with the stencil of FIG. 2.

Use of the prepared slurry may be economized by spraying through rectangular holes 200 in a temporary mask 220, (held firmly against the back or gun side of the shadow mask, such as by vacuum) to deposit slurry only in those areas where phosphor characters are to be produced. After partial drying, (complete drying prior to exposure would render the coating permanently insoluble and thus insensitive to actinic radiation), the rectangular areas are exposed through a positive photomask, one rectangular section 300 of which is shown in FIG. 3. Transparent area 320 passes radiation, resulting in solubilization of the underlying photosensitive layer, while opaque areas 340 and 360 block radiation, preventing solubilization and thus defining the desired phosphor pattern.

Figure 4A:
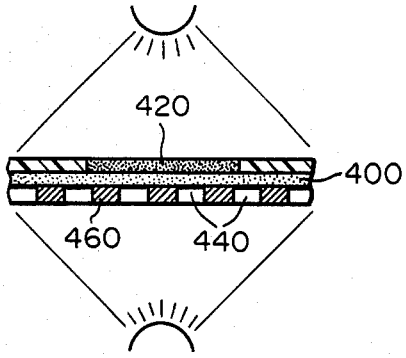
FIG. 4(*a*) is a section view of a portion of a shadow mask and photoresist-phosphor layer during exposure and prior to development.
Figure 4B:
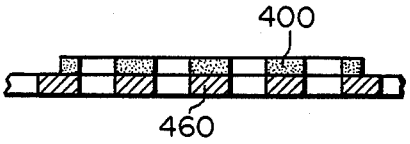
Figure 5:
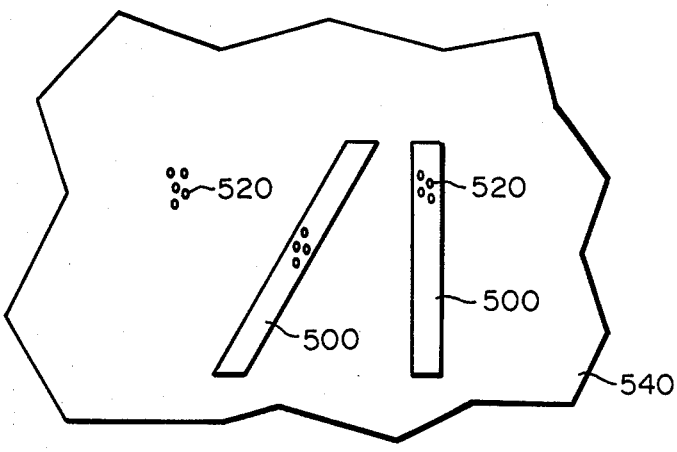
FIG. 5 is a plan view of a phosphor character produced by the invention.

The exposure steps may either be carried out separately or simultaneously, as shown in FIG. 4(*a*), where photosensitive layer 400 carrying phosphor particles is exposed through positive photomask 420 and apertures 440 of aperture mask 460. FIG. 4(*b*) shows mask 460 and photosensitive layer 400 after removal of the positive mask, drying and development of layer 400 to remove solubilized portions. FIG. 5 shows a phosphor character 500 bridging many apertures 520 in aperture mask 540, after baking to remove the photoresist from the developed layer 400.

EXAMPLE

A phosphor/photoresist slurry for spraying was prepared as follows:

A photoresist composition was prepared by mixing well the following ingredients:

51 grams of a 5.66 weight percent solution of PVA
1.67 grams of ferric ammonium oxalate in 10 milliliters of water
1.27 grams of ferric nitrate in 10 milliliters of water
2 grams of butane diol A phosphor suspension was prepared by ball milling the following composition for 16 hours in a ½ pint ball mill with 25 burundum cylinders ½ inch by ½ inch:

50 grams of P47 phosphor
2.2 grams of 0.5 micron average particle size $YVO_4$:Eu phosphor
1 gram of Marasperse N-22
30 grams ethyl alcohol
37.5 grams deionized water One-sixth of the resultant suspension and 20 grams of ethyl alcohol were added to the photoresist composition and stirred to form a slurry for spraying.

A stencil having an array of one inch by one and one-half inch was placed against the gun side of a cathode ray tube shadow mask and the mask was positioned on a vacuum box to hold the mask and stencil firmly in place during spraying. The mask was sprayed to a thickness of about 0.001" to 0.004", and the stencil was removed. The mask was then dried with ambient air for about 45 seconds to partially remove water from the sprayed layer. The partially dried and immobile layer was then exposed through a positive photomask to ultraviolet radiation having dominant wavelengths within the range of about 254 nm to 375 nm, for nine minutes to solubilize the exposed portions of the layer. The opposite side of the aperture mask was then exposed to the same radiation for one minute to solubilize the sprayed layer portions in the shadow mask aperture areas. The sprayed and exposed mask was then baked at about 109° F. (43° C.) for about 6 minutes to completely remove water from the phosphor/photoresist layers, thereby insolubilizing the unexposed portions. The exposed and baked mask was then developed by soaking in water for about 45 seconds, and rinsing in flowing water for about 20 seconds to remove the exposed portions of the layers. Later, during cathode ray tube assembly, the remaining photoresist was removed from the layers by baking at about 450° C. for about one hour. The resultant shadow mask had a uniform, adherent layer of phosphor characters on its gun side, which characters, despite bridging several mask apertures, were substantially invisible to the viewer of the display screen image during cathode ray tube operation.

While there has been shown and described what are at present considered the preferred embodiments of the invention, it will be obvious to those skilled in the art that various changes and modifications may be made therein without departing from the scope of the invention as defined by the appended claims.

For example, instead of spraying a phosphor-photoresist slurry onto the mask, the mask may first be coated with photoresist, and then a phosphor layer adhered to the wet photoresist by "dusting", i.e., contacting the layer with air-borne phosphor particles. A similar dusting technique is presently used by some cathode ray tube manufacturers to apply color phosphor to the CRT screen area, and is thus well-known in the art.

We claim:

1. A photographic process for providing a phosphor pattern on one side of a color cathode ray tube shadow mask, the tube comprising in addition to the mask; an electron gun, a viewing panel opposite the gun, a phosphor screen on the interior surface of the panel; said mask being metal and bearing a protective oxide coating, and defining an array of apertures for directing electron beams from the gun to desired phosphor elements on the screen when the mask is positioned within the viewing panel spaced from the screen; said apertures being smaller in size relative to the phosphor pattern on the mask, whereby the phosphor pattern bridges individual apertures; said process comprising the steps of:

(a) applying a uniform layer of a positive-working photoresist composition to the shadow mask surface, at least in the areas where phosphor is desired;

(b) applying a uniform layer of phosphor particles in contact with the photoresist layer;

(c) exposing the photoresist layer to actinic radiation through a positive photomask to solubilize the exposed portions of the photoresist layer;

(d) exposing the reverse side of the shadow mask to actinic radiation to solubilize portions of the photoresist layer in the areas of the shadow mask apertures;

(e) contacting the photoresist layer with a solvent to remove the solubilized portions of the layer; and (f) baking the shadow mask to remove the remaining photoresist, leaving a uniform, adherent layer of phosphor pattern on the mask.

2. The process of claim 1 wherein the layers of photoresist and phosphor are applied simultaneously by applying a slurry of phosphor particles in the photoresist composition to the shadow mask.

3. The process of claim 2 wherein the slurry is sprayed onto the mask.

4. The process of claim 3 wherein the slurry is sprayed through a pattern mask having an array of apertures.

5. The process of claim 1 wherein the positive working photoresist composition is an aqueous-based composition.

6. The process of claim 5 wherein the photoresist composition comprises a mixture in water of a simple ferric salt, a stable ferric acid salt, polyvinyl alcohol and a diol.

7. The process of claim 6 wherein following exposure, the photoresist layer is dried to render the unexposed portions thereof insoluble.

8. The process of claim 7 wherein drying is accomplished by heating the photoresist layer at a temperature of about 40° C. to 46° C. for about 4 to 10 minutes.

* * * * *